US006016571A

United States Patent [19]

Guzman et al.

[11] Patent Number: 6,016,571

[45] Date of Patent: Jan. 25, 2000

[54] COOPERATIVELY-PAIRED RETICULATE AND SPONGE WORKGLOVES

[76] Inventors: Paul J. Guzman; Sheri L. Guzman, both of 10084 E. Glendon Cir., Santee, Calif. 92071

[21] Appl. No.: 09/225,119

[22] Filed: Jan. 4, 1999

[51] Int. Cl.[7] ..... A41D 19/00

[52] U.S. Cl. ..... 2/167; 2/161.6; 2/163; 15/227

[58] Field of Search ..... 2/16, 159, 161.6, 2/161.7, 161.8, 163, 167, 168; 15/227

[56] References Cited

U.S. PATENT DOCUMENTS

| | | | |
|---|---|---|---|
| D. 268,968 | 5/1983 | Sami | D2/373 |
| 2,958,593 | 11/1960 | Hoover | 51/295 |
| 3,151,333 | 10/1964 | Scholz | 2/161 |
| 3,748,792 | 7/1973 | Lamb | 51/391 |
| 3,857,133 | 12/1974 | Linenfelser | 15/118 |
| 3,885,249 | 5/1975 | DuBrabander | 2/161 R |
| 4,038,787 | 8/1977 | Bianchi | 51/391 |
| 4,065,826 | 1/1978 | Hough | 15/227 |
| 4,593,427 | 6/1986 | Ortolito | 15/227 |
| 4,621,388 | 11/1986 | Ortolito | 15/227 |
| 4,670,930 | 6/1987 | Lu | 15/118 |
| 4,694,508 | 9/1987 | Iriyama | 2/21 |
| 5,127,976 | 7/1992 | McLeish | 156/242 |

OTHER PUBLICATIONS

Applicant's PTO/Disclosure Document . . . #443,663—Filed Sep. 8, 1998.

*Primary Examiner*—Diana Oleksa
*Assistant Examiner*—Kate Moran
*Attorney, Agent, or Firm*—Don E. Erickson

[57] ABSTRACT

The notion of a combination pair of work-gloves preferably formed of an imperforate latex type material generally found in the kitchen for protecting hands from detergent-soaps. The respective left and right members of the glove pair preferably functioning cooperatively to achieve a uniquely effective cleaning procedure, otherwise unattainable via a single handglove (or single-function pair). One of the pair of dual-function gloves features a scrub-pad substrate of polyester reticulate-fiber material permanently bonded to certain palm-side regions; while the companion glove features a sponge-pad substrate of open-celled cellulose-acetate material. Both glove embodiments featuring an optional wrapover of the fingernail tip regions, enhancing their respective scrubbing and absorbing actions. In use, the right-hand glove may serve the scrubbing function, while the left-hand glove may serve in follow-up rinse-cleaning operation;—or, the gloves may be employed independently.

12 Claims, 1 Drawing Sheet

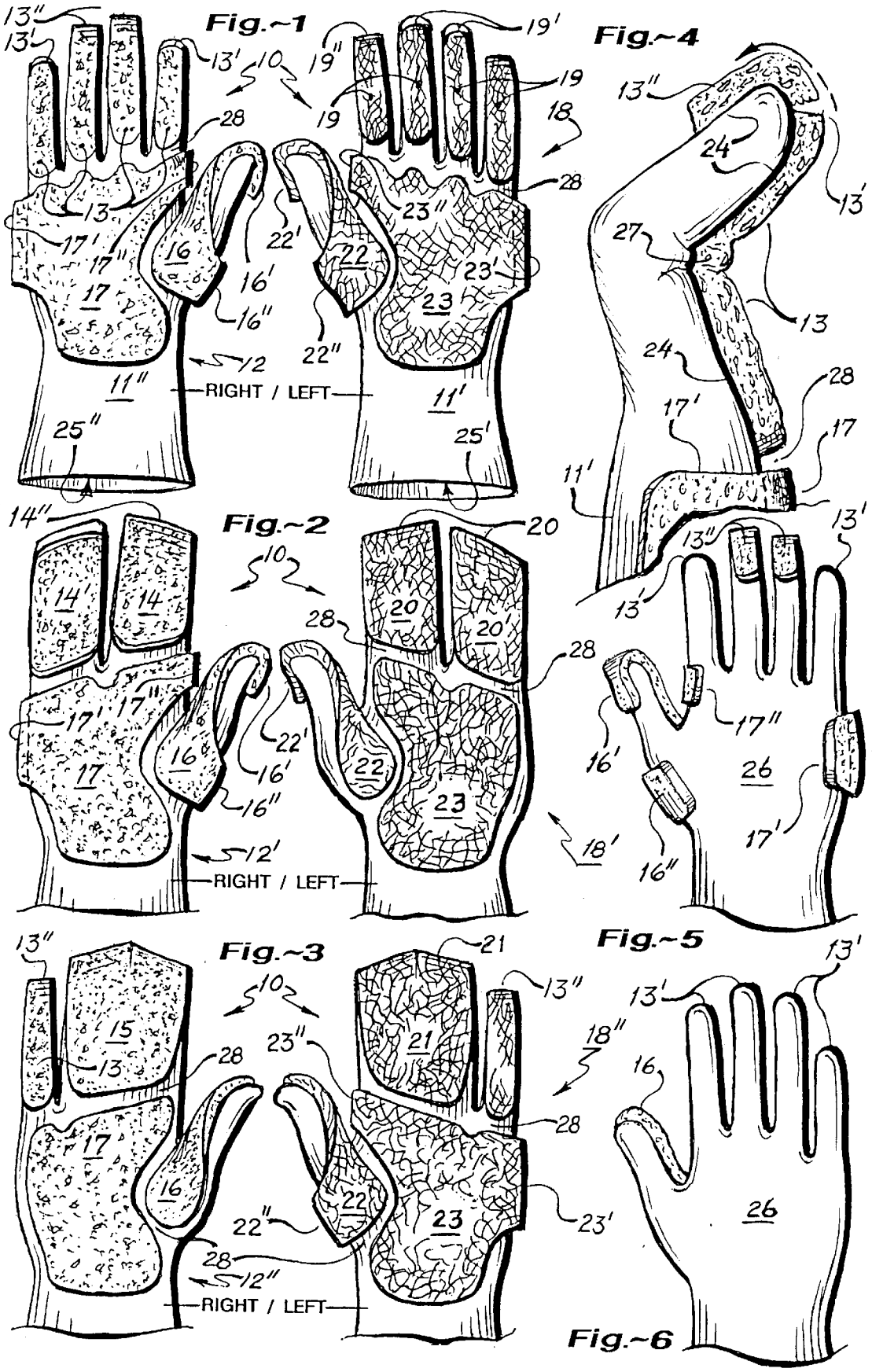
Fig.~1
Fig.~2
Fig.~3
Fig.~4
Fig.~5
Fig.~6
RIGHT / LEFT
RIGHT / LEFT
RIGHT / LEFT

COOPERATIVELY-PAIRED RETICULATE AND SPONGE WORKGLOVES

BACKGROUND OF THE INVENTION

1. Field of Invention

This invention relates to waterproof handgloves for the workforce, and more specifically it relates to those types of workgloves having special surfacing applique treatment conducive to cleaning tasks.

2. Relevant Prior-Art

Background research discovery provides some prior patent-art regarded as germane to this disclosure, chronologically for example U.S. Pat. No. 2,958,593 (filed: January 1960 to 3M-corp.) shows a non-woven reticulated (fiberous) polyester-foam material originally and still popularly known (among others) as SCOTCHBRITE™, which being very tough-bodied functions well in scrub-scouring of caked-on grime and grit;—owing to its generally coarsely open-celled (75–90% intersticial void areas, variable by mfg. process) texture.

In U.S. Pat. No. 3,151,333 (filed: November 1962 via Germany) shows a workglove claimed particularly useful for cleaning/peeling of vegetables, by having abrasive faced palm, finger, and thumb surfaces permanently treated with a flexible PVC(polyvinyl-chloride) substrate containing myriad sharp-edged such as PVC-granules. The gloves are made in like left and right pairs, and generally of sewn construction, to which abrasive-granules are applied via a full hot (180 F.-degree) PVC-dipping process.

In U.S. Pat. No. 3,748,792 (filed: March 1970) is shown a single worker's sewn-fabric sanding-glove made to fit both user's left and right hand (switching said to allow the other hand/arm to rest); the sandpaper is therefore stitched upon both sides of the glove, plus a stretchable-cuff portion is provided about the wearer's wrist.

In U.S. Pat. No. 3,885,249 (filed: January 1974) is shown work-glove (or work-mitt), featuring an avulsable sanding, polishing, wiping, palm-surface medium which is attached via hook-&-loop material such as VELCRO™.

In U.S. Pat. No. 3,857,133 (filed: March 1973) is shown a scrub-&-wipe type of sponge, owing that it combines the toughness of the SCOTCHBRITE™ type scrubbing-foam with a more water-absorbent small/open-celled type of cellulose-acetate/foam;—hence, the combined characteristics of the two different cellular-foam materials bonded together, provides the user with novel flip-over convenience during a manual cleaning procedure. However, separate water-tight handgloves must be warn in order to protect one's hands from caustic cleaning solutions.

In U.S. Pat. No. 4,038,787 (filed: March 1976) shows a flexible imperforate rubber work-glove having a plurality of non-absorptive spot-like silicon-carbide abrading-grit pads bonded (via waterproof-adhesive) at the regions of the finger-stalls between the finger-joints, thumb-joints, including multiple dot-like or transverse-strip pads affixed to the palm area.

In U.S. Pat. No. 4,065,826 (filed: November 1975 via U.K.) is shown a disposable (meaning readily throw-away) clinical wash-mitt, the working-surface of which features a bonded-on shorthair-fiber like pile (based upon a then earlier U.K.-Pat.#1,378,640).

In U.S. Pat. No. D-268,968 (filed: April 1981) is shown another work-glove featuring a fiberous-pile like applique to the underside of the fingers and palm region.

In U.S. Pat. No. 4,593,427 (filed: August 1984 & December 1984) is shown an imperforate workglove for scouring known as SCRUB-EEZE™, featuring an absorptive sponge-like under-layer supporting an abrasive-grit surfaced outermost-layer; including a substantially transverse linear flexile region of the palm which is claimed to include the necessarily more rigid aggregate layered scouring medium. Additionally, VELCRO™ attached scouring-pads are indicated at the upper-side of the fingers, enabling an optional knuckle scouring capability.

In U.S. Pat. No. 4,670,930 (filed: October 1984) is shown a hand-mitt for scrubbing surfaces via slanted/short-bristles upon one side and a said substantially hairy-cloth upon the opposite-side.

In U.S. Pat. No. 4,694,508 (filed: September 1986 via Japan) is shown a somewhat thimble-like finger-tip detachable protectors for application to each finger of regular work-gloves, featuring an opening in the under-side of the finger through which it is said the user may still sensatively feel a surface being worked-on.

In U.S. Pat. No. 5,127,976 (filed: September 1989 via australia) is shown one methodology by which to make a scrubber type work-glove, wherein a planar aluminum handglove-pattern is vertically-dipped into a vat of liquid latex-rubber until about 1 mm-thickness of coating has adhered, whereupon the resultant laytex-shell is leached in bromine of antioxidents on both sides (inside/outside) which is said to toughen the latex-glove while preserving its flexibility. Next, a substrate-coating of ICI-9521/urethane-resin (cross-linked with ICI 3.5%/Delta-bond AR) is discretely applied by roller to the finger-undersides of the latex-glove, as well as to an applique of SCOTCHBRITE®-pad (or alternately, a half-portion of VELCRO® attaching material, to which the mating portion having a sponge, cloth, or brush, may later be attached); and once dry to the touch, then joined in alignment for about ½ hr.@72° f. while the bonding-agent substrate cures, and the scouring-pad is permanently joined to the underside of the glove.

Therefore, in full consideration of the preceding patent review, there is determined a need for an improved form of device to which these patents have been largely addressed. The instant inventor hereof believes their newly improved manual scouring and wiping device, commercially referred to as the HANDI-SCRUBS™, currently being developed for production under auspices of the Guzman-Mfg./Mkt.Co., exhibits certain advantages as shall be revealed in the subsequent portion of this instant disclosure.

SUMMARY OF THE INVENTION

A.) In view of the foregoing discussion about the earlier invention art, it is therefore important to make it pellucid to others interested in the art that the ultimate object of this invention disclosure is to provide a combination system of cooperatively-paired workgloves by which function uniquely in support of each other by virtue of a first-glove being faced with a non-absorbent open-celled reticulate scrubbing medium, the second-glove being faced with a high-absorbency open-celled rinsing/wiping sponge medium;—thereby achieving an optimal efficiency (synergistic inter-working action) heretofore unattainable via a single handglove, nor via a single-function of pair like clad workgloves). Plus, the notion of integrating these different scrub and sponge materials into imperforate respective left & right(or right/left) handgloves, overcomes the earlier stated disadvantage of discussed U.S. Pat. No. 3,857,133,—which teaches use of less effective polyurethane both for the sponge and for the mated reticulated material. While urethane-resins are certainly superior for certain other types of products, the particular application being addressed herein finds urethane to be a substantially less effective material.

B.) Another object of this invention disclosure is to independently set forth a first work-glove according to previous item-A, made of an imperforate flexible material such as latex-rubber and clad with a tough preferred ⅜th-inch (¼-inch to ½-inch workable) layer of coarsely reticulated open-celled polyester-foam material such as 3M/SCOTCHBRITE®. The glove is conventionally configured with either five individual finger and thumb appendages, or configured into three appendages comprising the thumb and little-finger appendages plus a larger appendage receiving the three larger-fingers. Both the undersides (faces) of the palm and the finger appendages are permanently clad with discrete pad formations of the polyester-foam material (referenced in afore discussed U.S. Pat. No. 2,958,593;—and the material is to preferably wrap 180-degrees around the tips of the glove fingers, as to thereby overlap proximal the wearer's fingernail region. A reliable permanent waterproof-bond between the flexible latex glove and reticulated material has been achieved by a flexible industrial adhesive substrate known as E-6000 (mfg. by Eclectic Products, Inc.), which exhibits excellent resistance to caustic cleaning solutions. The advantage of employing a reticulated scrubbing over the prior-art sandpaper like abraisive surface, resides in a scouring action which cannot scratch a soft surface such as a linoleum kitchen-floor for example,—yet does not easily clog.

C.) Another object of this invention disclosure is to independently set forth a second work-glove according to previous item-A, also preferably made of an imperforate flexible material such as latex-rubber, clad with a preferred ⅜th-inch (¼-inch to ½-inch workable) layer of durable but relatively much smaller open-celled celouse-acetate foam material such as marketed by 3M/Home & Commerial Care Div.(St. Paul, Minn., USA). The glove is also configured with either five individual finger and thumb appendages, or configured into three appendages comprising the thumb and little-finger appendages, plus a larger appendage receiving the three larger-fingers. Both the undersides(faces) of the palm and the finger appendages are permanently clad with discrete pad formations of the celouse-acetate foam material (mentioned in afore discussed U.S. Pat. No. 3,857,133;—and the material is to also preferably wrap 180-degrees around the tips of the glove fingers, as to thereby overlap proximal the wearer's fingernail region. A reliable permanent waterproof-bond between the flexible latex glove and sponge material has been likewise achieved via the flexible industrial adhesive substrate known as E-6000 (mfg. by Eclectic Products, Inc.), which exhibits excellent resistance to caustic cleaning solutions such as chlorinated-cleaners. The advantage of employing a cellulose-acetate foam sponge material over urethane-foam material for example, resides in its particular ruggedly dense cellular structure, yet which is capable of interstitially holding a high proportion of water-volume.

DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

FIG. 1, is an underside plan-view of our new workgloves, revealing the preferred arrangement of the respective reticulate and sponge materials bonded upon the primary working surfaces;

FIG. 2, is another underside plan-view of the pronated workgloves, with a fragmented sleeve portion, and revealing a generic-variant embodiment of the glove-body and the respective reticulate and sponge materials bonded thereto;

FIG. 3, is another underside plan-view of the workgloves, revealing another generic-variant embodiment of the glove-body and the respective reticulate and sponge materials bonded thereto;

FIG. 4, is a 6X-enlarged general detail side-view of an exemplified glove-finger portion, wherein is shown fragmented the full-finger applique in direct comparison to the optional phantom-outlined wrap-around variant;

FIG. 5, is an upperside plan-view of a right workglove, showing how the respective reticulate or sponge materials are preferably wrapped around portions thereto;

FIG. 6, is an alternate embodiment plan-view thereof, showing how the workglove upperside can appear substantially conventional without wrap-around features if preferred.

ITEMIZED NOMENCLATURE REFERENCES

10—cooperatively-paired workgloves
11'/11"—base flexile glove body (left/right)
12/12'/12"—sponge clad glove (full-fingered/bifurcated-fingered/tridigital-fingered)
13,13',13"—individualized finger sponge, rounded terminus, optional wrap-around
14,14',14"—bifurcated finger sponge (inward/outward), fingernail wrap-around
15,15'—tridigital finger sponge, fingernail wrap-around
16,16',16"—thumb sponge, thumbnail wrap-around, thumb lateral-wrap
17,17',17"—palm area sponge, inward-wrap, outward-wrap
18,18',18"—reticulate clad glove (full-fingered/bifurcated-fingered/tridigital-fingered)
19,19',19"—individualized finger reticulate, rounded terminus, optional wrap-around
20,20',20"—bifurcated finger reticulate (inward/outward), fingernail wrap-around
21,21'—tridigital finger reticulate, fingernail wrap-around
22,22',22"—thumb reticulate, thumbnail wrap-around, thumb lateral-wrap
23,23',23"—palm area reticulate, inward-wrap, outward-wrap
24—adhesive substrate
25'/25"—hand entry sleeve-opening (left/right)
26—upper-surface of basic workglove
27—characteristic gathering effect
28—interstitial gap

DETAILED DESCRIPTION OF THE PREFERRED EMBODIMENTS

Initial reference is given by way of FIG. 1, wherein is exhibited our basic cooperative combination-pair 10 of scrubbing and rinsing workgloves for simultaneous wearing upon opposed hands by a user, enabling an ultimately efficient manual cleaning action; the combined action of which has been found to perform a synergistic effect, attaining results superior to that attainable via either cleaning medium alone. Based upon a substantially conventional flexile and imperforate preferably latex-rubber glove bodies 11' & 11" (mirror images of each other); having usual hand entry sleeve-opening portions 25' and 25" respectively. Their primary working surfaces are those inderside areas of the palm, fingers and thumb observable in the underside planviews of FIGS. 1,2,3; to which are permanently clad the special cleaning materials. In FIGS. 1,2,3 the exemplified left-hand generic-variant workgloves 12, 12', 12" comprising a base flexile glove body 11" preferably made of a conventional latex-rubber compound (such as widely marketed by RubberMaid® Corp.), their primary working surfaces (identified as the underside of the palm, fingers, and thumb) being clad with a commercially available reticulate non-clogging abrasive scrubbing material (such as currently produced by 3M-Coproration). Also, in FIGS. 1,2,3, are the opposing generic-variant workgloves 18, 18', 18", the pronated working surfaces of which are shown in contrast clad with a a commercially available tough bodied albeit very absorbent sponge preferably compounded of conventional celouse-acetate foam material.

There remain subtle, however vital other differences which are to become herein more evident and understood as important improvements. For example, FIG. 1 shows how the individually articulatable fingers of both the left and right workgloves 12 and 18 may be clad with their respective above identified scrubbing mediums, preferably leaving an unclad interstitial space 28 there between their respective adjoining palm region scrubbing mediums 17 and 23. Note that the exemplified sponge medium material 13 of the right-hand workglove fingers, and 19 of the left-hand workglove fingers, can be permanently rounded off as is exemplified 13' and 19',—or optionally, formed permanently wrapped 180-degrees around the finger tips 13" and 19";—as is further exemplified in the auxiliary side-view of FIG. 4. Observe also, how the workglove thumbs of FIG. 1 are also preferably clad with their respective like working medium materials 16 and 22, including a similar optional wrap-around effect at 16' and 22';—plus, an additional optional minimal 90-degree lateral-wrap at 16" and 22" respectively (also ref. FIG. 4). Accordingly, it is preferred that the reticulate and sponge working medium materials, not be combined upon a single workglove, in as much as it would defeat the desired synergistic effect, achieved in working the two workgloves in harmony with each other, each doing what the other cannot do. However, it is preferred that the waterproof adhesive substrate 24 exemplified in FIG. 4, be commonly employed as to permanently join the entire interfacing surfaces of both the working-medium materials (reticulate and sponge) to the surface of the workglove material.

Next, the workglove examples of FIG. 2 reveal how the finger portions may be compounded in a novel manner creating the reticulate bifurcations 20 and 20', and likewise the finger-stall sponge bifurcations 14 and 14';—which serve the advantage of providing an approximately 30%-increased working area for both the working mediums in the finger region. This concept has been carried still further as revealed in FIG. 3, wherein a primary tridigital finger-stall sponge appendages 15 and 21 are both shown flanked by a solitary finger-stall appendage 13. Here, both the tridigital and unitary appendages are shown provided with the 180-degree wrap-around of the respective working mediums about the finger-tips as to terminate proximally at the base inward region of the wearer's fingernails. This generic-variant embodiment functions to substantially retain the articulating flexibility of the FIG. 1 embodiment,—whilst increasing the effective working-surface area at the finger region some 40%.

Reference to FIG. 5 exemplifies the opposite upper-side characteristic of both the reticulate and sponge clad workgloves. Note here how the palm portion working medium materials of FIGS. 1–3, preferably include exemplified wrap-around portions 17'; and the similarly treated thumb lateral-wrap portion 16". Finally, FIG. 6 serves to exemplify the upper-side appearance of a workglove not provided with the optional wrap-around portions of working-medium materials;—although the opposing thumb-tip terminating embodiment of sponge material 16 (or alternately, reticulate 22) is still generally observable in this pronated observation aspect. While it is preferred that our respective workgloves bearing reticulate and sponge material be employed in a cooperative manner;—first, scrubbing loose tough to loosen grime deposits via the reticulate clad workglove,—followed by swiping clean via the sponge's rinsing action;—it remains that the respective reticulate and sponge clad workgloves may also be employed independently to advantage as well. The notion of either partial or full wrap-around portions associated with both the reticulate and sponge clad workgloves, serves to advantageously scrub or rinse clean various reach-in regions of pots and pans, removing grime from the interior regions of a stove's oven; or, entirely apart from the kitchen, serving ideally for removing excess wet-cement from a bricking job in progress for example.

Thus, it is readily understood how the preferred and generic-variant embodiments of this invention contemplate performing functions in a novel way not heretofore available nor realized. It is implicit that the utility of the foregoing adaptations of this invention are not so necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A cooperative combination-pair of scrubbing and rinsing workgloves for simultaneous wearing upon opposed hands by a user, said workgloves comprising:

a first flexile imperforate workglove having a palm side, the palm side having a working surface, the working surface substantially clad with a conventional reticulate abrasive type scrubbing medium;

a second flexile imperforate workglove having a palm side, the palm side having a working surface, the working surface substantially clad with a conventional open-cell absorbent type rinsing medium; and wherein the first workglove is for employment upon one of the user's hands and wherein the second workglove is for employment upon the user's other hand.

2. The combination workgloves of claim 1, wherein said reticulate material is a polyester based low-density non-woven fiber, and wherein the open-cell absorbent type rinsing medium is a cellulose-acetate based material.

3. The combination workgloves of claim 1, wherein the workgloves have fingers, and the reticulate material extends 180-degrees around the tips of the fingers to terminate proximal the base region of user's fingernail.

4. The combination workgloves of claim 1, wherein said reticulate material of the palm side extends to wrap at least 90-degrees around the side of the workglove.

5. The combination workgloves claim 1, wherein the workgloves have fingers, and the the open-cell absorbent type rinsing medium extends 180-degrees around the tips of the fingers to terminate proximal the base region of the user's fingernails.

6. The combination workgloves of claim 1, wherein the open-cell absorbent type rinsing medium of the palm side extends to wrap at least 90-degrees around the side of the workglove.

7. The combination workgloves of claim 1, wherein said clad condition is a permanent bond using Eclectic-6000 industrial adhesive.

8. The combination workgloves of claim 1, wherein each imperforate workglove is made of a Latex-rubber substance.

9. The combination workgloves of claim 1, wherein the primary working surfaces include a palm area and individualized finger stall appendages.

10. The combination workgloves of claim 1, wherein the primary working surfaces include a palm area and bifurcated finger stall appendages.

11. The combination workgloves of claim 1, wherein the primary working surfaces include a palm area and a tridigital finger-stall appendage flanked by a solitary finger-stall appendage.

12. The combination workgloves claim 1, wherein the reticulate material is approximately ¼–½ inch in thickness and the absorbent material is approximately ¼–½ inch in thickness.

* * * * *